US006968758B2

(12) United States Patent
Lin

(10) Patent No.: US 6,968,758 B2
(45) Date of Patent: Nov. 29, 2005

(54) WRENCH ADAPTOR FOR DRIVING SCREW DRIVER BITS

(76) Inventor: Yi Chung Lin, No. 308, Wu Guang Road, Wu Zh Hsiang, Taichung Hsien (TW) 414

( * ) Notice: Subject to any disclaimer, the term of this patent is extended or adjusted under 35 U.S.C. 154(b) by 99 days.

(21) Appl. No.: 10/763,455

(22) Filed: Jan. 22, 2004

(65) Prior Publication Data

US 2004/0159193 A1 Aug. 19, 2004

(30) Foreign Application Priority Data

Feb. 19, 2003 (TW) ..... 92202692 U

(51) Int. Cl.[7] ..... B25B 23/00
(52) U.S. Cl. ..... 81/438; 81/63.2; 81/176.1
(58) Field of Search ..... 81/438, 60, 61, 81/63.2, 176.1, 177.85, 177.1, 180.1

(56) References Cited

U.S. PATENT DOCUMENTS 3,253,626 A * 5/1966 Stillwagon Jr. et al. ..... 81/460
6,006,631 A 12/1999 Miner et al. ..... 81/177.85
6,019,019 A 2/2000 Hobbs ..... 81/177.2
6,257,096 B1 * 7/2001 Ling ..... 81/60
6,601,476 B2 * 8/2003 Hu ..... 81/60
6,647,831 B2 * 11/2003 Hu ..... 81/60
6,868,758 B2 * 3/2005 Chen ..... 81/60

* cited by examiner

*Primary Examiner*—Joseph J. Hail, III
*Assistant Examiner*—Alvin J. Grant
(74) *Attorney, Agent, or Firm*—Charles E. Baxley

(57) ABSTRACT

An adaptor device is developed for attaching to a wrench and for being driven by the wrench, the adaptor device includes an extension for attaching to the wrench, a shank extended from the extension and having an engaging hole to receive a tool member, the shank includes one or more slots to form one or more blades and to retain various tool members in the engaging hole of the shank. A ferrule includes a bore to receive the shank and includes an inclined surface to engage with the blade and to force the blade to engage with and to force against the tool member, or to release the blade from the tool member.

4 Claims, 5 Drawing Sheets

WRENCH ADAPTOR FOR DRIVING SCREW DRIVER BITS

BACKGROUND OF THE INVENTION

1. Field of the Invention

The present invention relates to an adaptor device, and more particularly to an adaptor device for attaching to wrenches and for driving screw driver bits or other tool members.

2. Description of the Prior Art

Various kinds of typical adaptor devices have been developed and attached to ratchet wrenches, and comprise a socket engaging portion or an actuator for attaching to and for driving sockets, in order to drive fasteners or the like.

For example, U.S. Pat. No. 6,006,631 to Miner et al., and U.S. Pat. No. 6,257,096 to Ling disclose two of the typical adaptor devices for attaching to ratchet wrenches, and for driving sockets. However, the typical adaptor devices may not be used for engaging with and for driving screw driver bits.

U.S. Pat. No. 6,019,019 to Hobbs discloses other typical adaptor devices for attaching to simple wrenches, and for driving sockets. However, similarly, the typical adaptor devices may not be used for engaging with and for driving screw driver bits.

U.S. Pat. No. 6,601,476 to Hu discloses further typical adaptor devices for attaching to ratchet wrenches, and for driving sockets. However, similarly, the typical adaptor devices may not be used for engaging with and for driving screw driver bits.

The present invention mitigates and/or obviates the afore-described disadvantages of the conventional adaptor devices for wrenches.

SUMMARY OF THE INVENTION

The primary objective of the present invention is to provide an adaptor device for attaching to wrenches and for driving screw driver bits or other tool members.

In accordance with one aspect of the invention, there is provided an adaptor device for attaching to a wrench and for being driven by the wrench, the adaptor device comprising an extension for attaching to the wrench, a shank extended from the extension and including an engaging hole formed therein, the shank including at least one slot formed therein to define at least one blade, a tool member engaged in the engaging hole of the shank, for being engaged with the blade of the shank, and a ferrule including a bore formed therein to receive the shank of the adaptor device, and including an inclined surface formed therein, to engage with the blade, the ferrule being movable relative to the shank, either to force the blade to engage with and to force against the tool member, or to release the blade from the tool member.

The shank includes an outer thread formed thereon, the ferrule includes an inner thread formed therein to thread with the outer thread of the shank, and to move the ferrule relative to the shank, in order to force the inclined surface of the ferrule against or away from the blade.

The adaptor device further includes a disc provided thereon. The extension of the adaptor device includes a spring-biased projection engaged therein.

Further objectives and advantages of the present invention will become apparent from a careful reading of the detailed description provided hereinbelow, with appropriate reference to the accompanying drawings.

BRIEF DESCRIPTION OF THE DRAWINGS

FIG. 1 is a perspective view of an adaptor device in accordance with the present invention for attaching to wrenches or the like;

DETAILED DESCRIPTION OF THE PREFERRED EMBODIMENT

Figure 1:
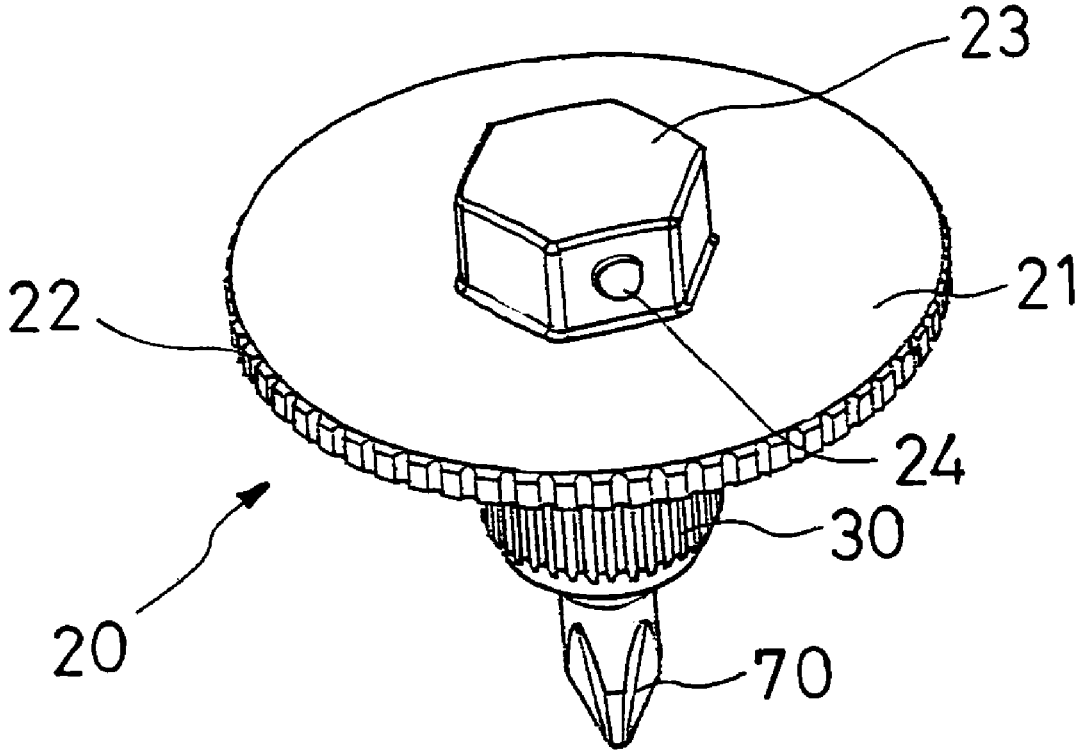
Figure 2:
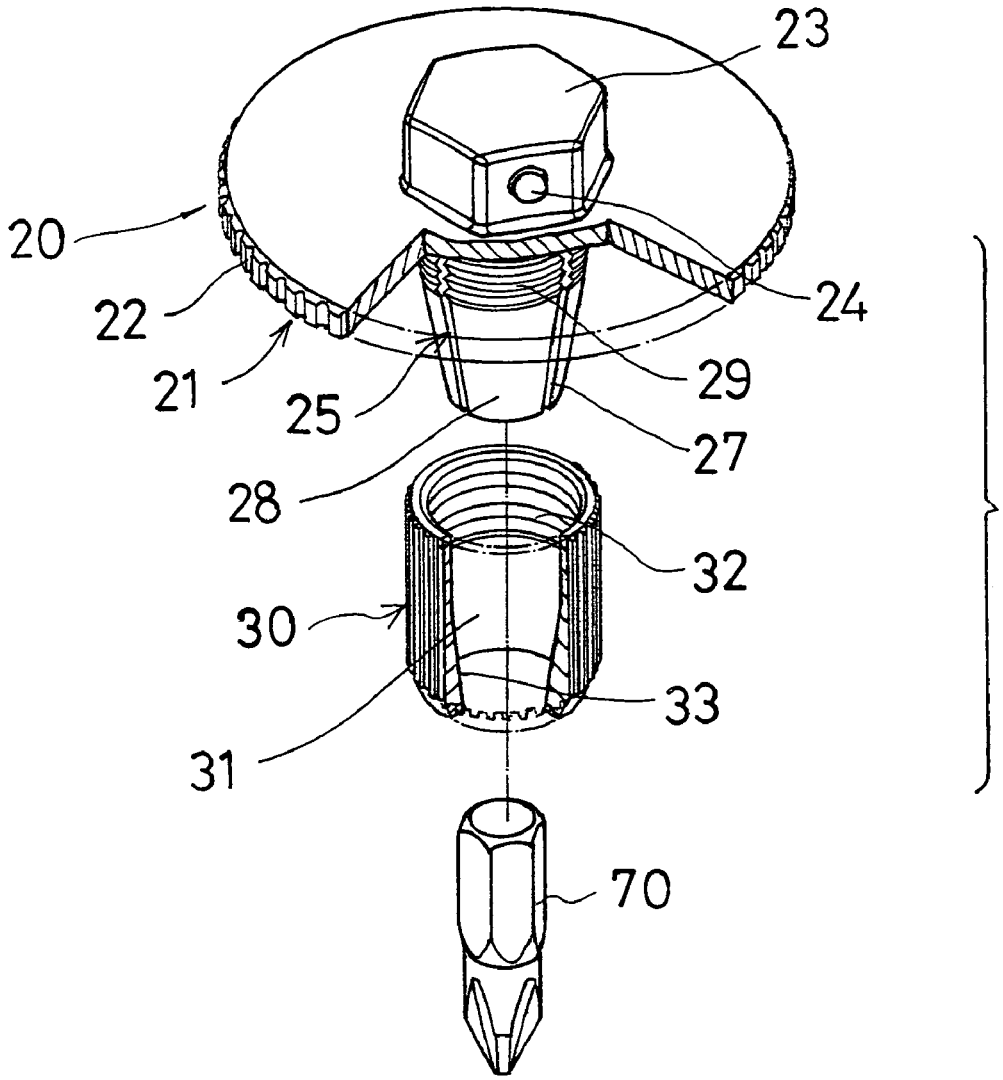
FIG. 2 is an exploded view of the adaptor device for wrenches.
Figure 3:
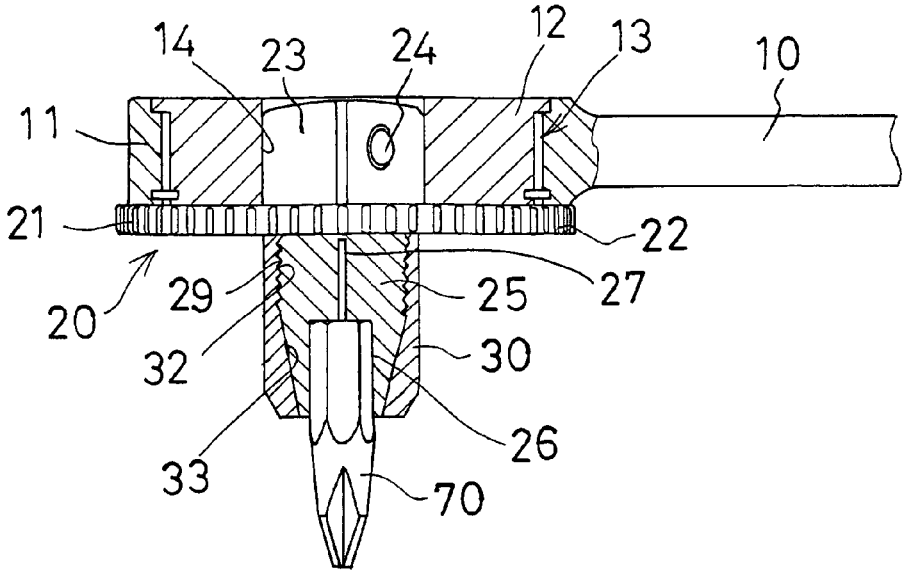
FIG. 3 is a partial cross sectional view illustrating the attachment of the adaptor device to a wrench.

Referring to the drawings, and initially to FIGS. 1–3, an adaptor device 20 in accordance with the present invention is developed and provided for attaching to a wrench 10, such as a usual ratchet wrench 10 which includes a head 11 having a usual ratchet wheel 12 engaged therein with a ratchet mechanism 13, in order to drive the adaptor device 20 in either direction.

The usual ratchet mechanism 13 has been disclosed in U.S. Pat. No. 6,257,096 to Ling and U.S. Pat. No. 6,601,476 to Hu, which are taken as references for the present invention. The usual ratchet wrench 10 includes a space 14 (FIGS. 3, 5) formed therein for receiving or attaching the adaptor device 20, in order to drive the adaptor device 20.

The adaptor device 20 comprises a disc 21 having a knurled outer peripheral surface 22 formed thereon for facilitating the rotating operation of the adaptor device 20 by users, and an extension 23 extended from the disc 21 and having a non-circular cross section, for engaging into the space 14 of the ratchet wrench 10, in order to be rotated or driven by the ratchet wrench 10.

It is preferable that the extension 23 of the adaptor device 20 includes a usual square or hexagonal cross section, for attaching or coupling to the ratchet wrench 10 directly or indirectly via other tool extensions (not shown). The adaptor device 20 includes a spring-biased projection 24 engaged therein, for engaging with the ratchet wheel 12 or the ratchet wrench 10 (FIGS. 3, 5), and thus for positioning the adaptor device 20 to the ratchet wheel 12 or to the ratchet wrench 10.

Figure 4:
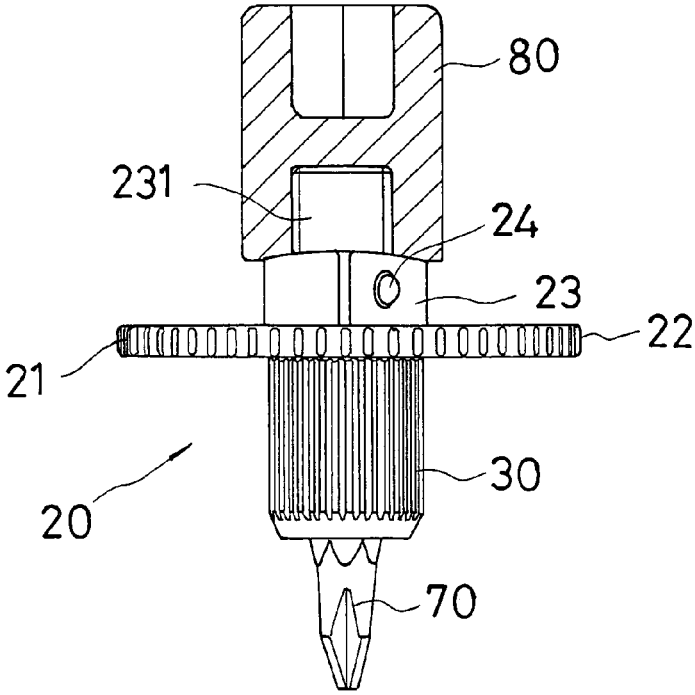
FIG. 4 is a partial cross sectional view similar to FIG. 3, illustrating the other arrangement of the adaptor device for wrenches.
Figure 5:
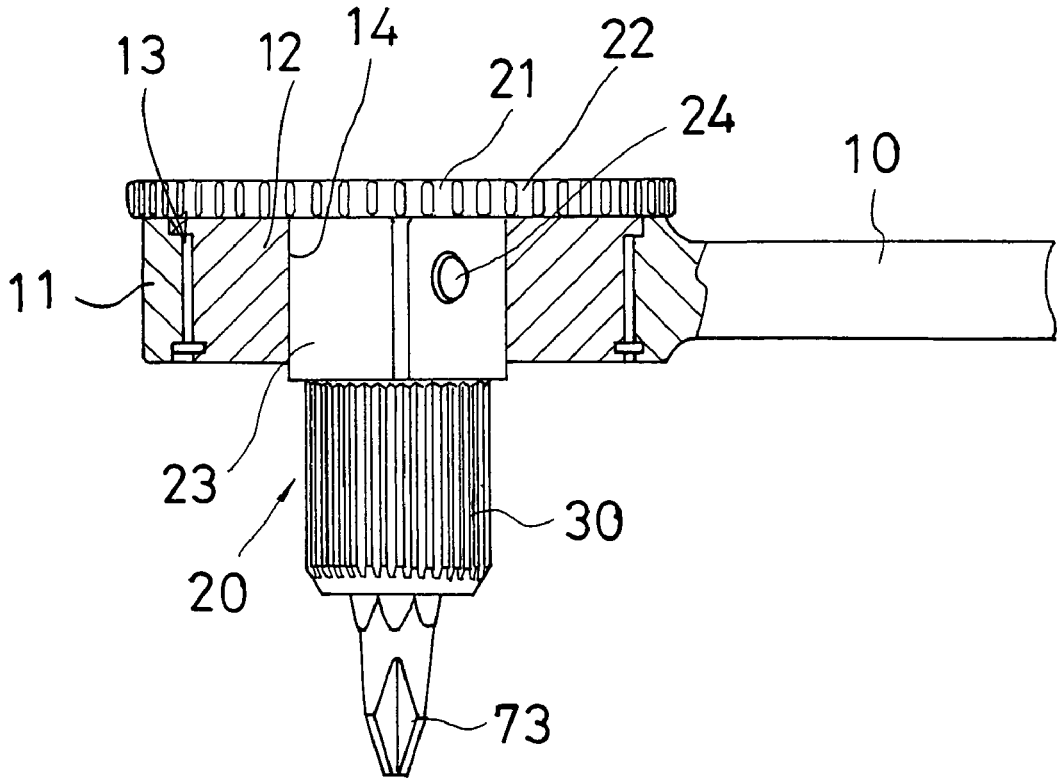
FIG. 5 is a partial cross sectional view similar to FIGS. 3 and 4, illustrating the other embodiment of the adaptor device for wrenches.

The adaptor device 20 includes a shank 25 extended therefrom, such as extended from the disc 21 (FIGS. 2–4), or extended from the extension 23 (FIG. 5). The shank 25 includes a non-circular engaging hole 26 formed therein (FIG. 3) for receiving or for attaching a screw driver bit 70 or other tool members (not shown), and for driving the screw driver bit 70 or the like.

The shank 25 includes one or more slots 27 formed therein to form or define one or more spring blades 28 for clamping or retaining the screw driver bit 70 to the shank 25. The shank 25 further includes an outer thread 29 formed thereon, such as formed in the upper portion thereof or located close to the disc 21 or close to the extension 23.

A ferrule 30 includes a bore 31 formed therein to receive the shank 25 of the adaptor device 20, and includes an inner thread 32 formed therein for threading with the outer thread 29 of the shank 25, in order to attach or to secure the ferrule 30 to the shank 25. The ferrule 30 includes a tapered or inclined surface 33 formed therein, for engaging with the blades 28.

In operation, the blades 28 may be forced against the screw driver bit 70, when the ferrule 30 is threaded onto the shank 25, in order to force the blades 28 to solidly engage with the screw driver bit 70, and thus to solidly secure the screw driver bit 70 to the shank 25, for allowing the screw driver bit 70 to be rotated or driven by the wrench 10.

On the contrary, when the ferrule 30 is threaded away from the shank 25, or is unthreaded relative to the shank 25, the inclined surface 33 of the ferrule 30 may be disengaged from the blades 28, and may thus release the blades 28 from the screw driver bit 70, such that the screw driver bit 70 may be engaged into or disengaged from the shank 25 freely.

As shown in FIGS. 3 and 5, it is preferable that the disc 21 includes an outer diameter greater than that of the head 11 of the wrench 10, to allow the users to hold and to rotate the adaptor device 20 directly with the disc 21, in some circumstances.

Referring next to FIG. 4, the extension 23 of the adaptor device 20 may include a non-circular protrusion 231 extended therefrom, for engaging or attaching to a socket 80 or other tool extensions (not shown), and thus for allowing the adaptor device 20 to be rotated or driven by the other wrenches or the other driving tools (not shown).

Figure 6:
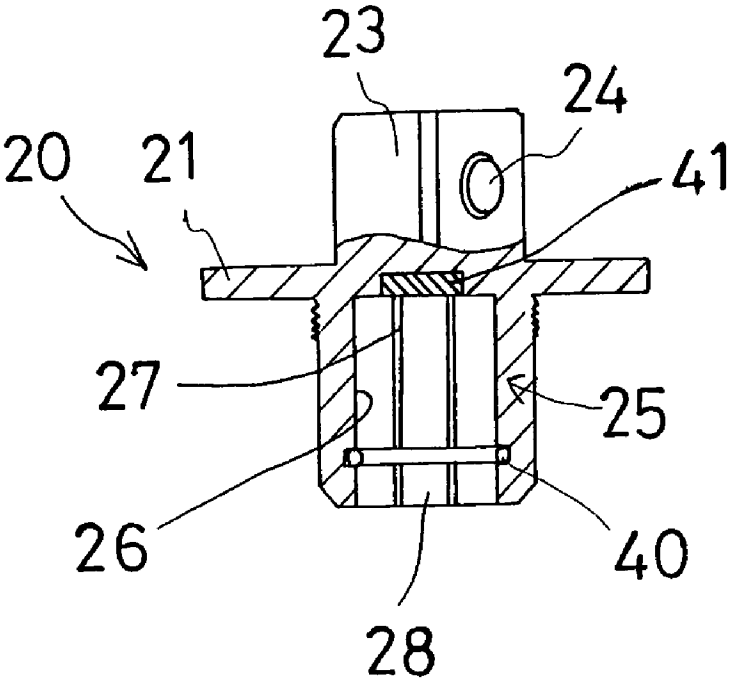
FIG. 6 is a partial cross sectional view similar to FIGS. 3–5, illustrating a further embodiment of the adaptor device for wrenches.

Referring next to FIG. 6, the shank 25 of the adaptor device 20 may further include a retaining ring 40 engaged therein for further stably attaching the screw driver bit 70 to the shank 25, and/or may further include a magnetic device 41 engaged therein for further stably attaching the screw driver bit 70 to the shank 25.

Figure 7:
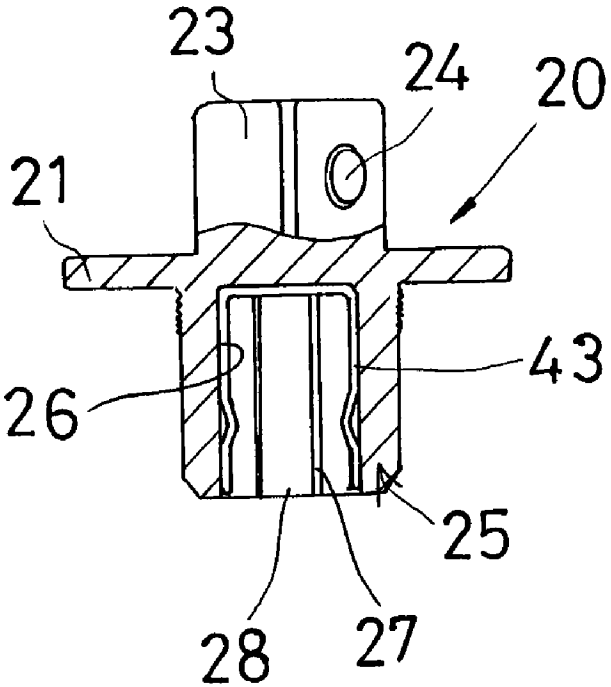
FIG. 7 is a partial cross sectional view similar to FIGS. 3–6, illustrating a still further embodiment of the adaptor device for wrenches.

Referring next to FIG. 7, alternatively, the shank 25 of the adaptor device 20 may further include a spring member 43 engaged therein for further stably attaching the screw driver bit 70 to the shank 25.

Accordingly, the adaptor device in accordance with the present invention may be provided for attaching to wrenches and for driving screw driver bits or other tool members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adaptor device for attaching to a wrench and for being driven by the wrench, said adaptor device comprising:

an extension for attaching to the wrench, a shank extended from said extension and including an engaging hole formed therein, said shank including at least one slot formed therein to define at least one blade, a tool member engaged in said engaging hole of said shank, for being engaged with said at least one blade of said shank, and a ferrule including a bore formed therein to receive said shank of said adaptor device, and including an inclined surface formed therein, to engage with said at least one blade, said ferrule being movable relative to said shank, either to force said at least one blade to engage with and to force against said tool member, or to release said at least one blade from said tool member.

2. The adaptor device as claimed in claim 1, wherein said shank includes an outer thread formed thereon, said ferrule includes an inner thread formed therein to thread with said outer thread of said shank, and to move said ferrule relative to said shank, in order to force said inclined surface of said ferrule against or away from said at least one blade.

3. The adaptor device as claimed in claim 1, wherein said adaptor device further includes a disc provided thereon.

4. The adaptor device as claimed in claim 1, wherein said extension of said adaptor device includes a spring-biased projection engaged therein.

* * * * *